United States Patent [19]

Webb

[11] Patent Number: 5,015,371

[45] Date of Patent: May 14, 1991

[54] SAFETY DEVICE FOR SEALING A DRAIN ASSEMBLY

[75] Inventor: James E. Webb, Richmond, Calif.

[73] Assignee: Nsertaseal Corporation, Richmond, Calif.

[21] Appl. No.: 461,686

[22] Filed: Jan. 8, 1990

[51] Int. Cl.[5] ..... E03F 5/06

[52] U.S. Cl. ..... 210/164; 210/85; 210/163; 210/459; 404/25; 404/26; 52/19; 52/20; 52/21; 138/89; 138/92; 138/94; 49/463; 49/466

[58] Field of Search ..... 210/85, 747, 163, 164, 210/165, 166, 459; 404/25, 26; 52/19, 20, 21; 138/89, 92, 94; 49/463, 466

[56] References Cited

U.S. PATENT DOCUMENTS

| | | | |
|---|---|---|---|
| 3,516,541 | 6/1970 | Hardingham | 210/164 |
| 3,556,993 | 1/1971 | Persson | 210/164 |
| 3,621,623 | 3/1970 | Downes | 52/20 |
| 4,305,679 | 12/1981 | Modi | 404/25 |
| 4,682,907 | 7/1987 | Gaudin | 210/164 |
| 4,737,220 | 4/1988 | Ditcher et al. | 52/20 |
| 4,776,722 | 10/1988 | Gaudin | 210/164 |

*Primary Examiner*—Robert A. Dawson
*Assistant Examiner*—David A. Reifsnyder
*Attorney, Agent, or Firm*—Thomas R. Lampe

[57] ABSTRACT

A safety device for sealing a drain assembly including a plate element defining a basin with the drain assembly, a housing element depending from the plate element closed to an underground line associated with the drain assembly, and a seal element positionable between the plate element and drain assembly to provide a substantially fluid-tight seal therebetween when liquid fills the housing element interior.

4 Claims, 2 Drawing Sheets

SAFETY DEVICE FOR SEALING A DRAIN ASSEMBLY

TECHNICAL FIELD

The present invention relates to a device for sealing a drain assembly leading from ground level to an underground line. The apparatus of the present invention provides a positive seal operable to both prevent hazardous substances from passing into the underground line from ground level and prevent possible harmful vapors in the underground line from entering the ambient atmosphere.

BACKGROUND ART

Oil refineries and other industries commonly utilize underground drain lines which are in communication with ground level through one or more drain assemblies. Such drain assemblies commonly include a grating support ledge and a peripheral wall extending a predetermined distance upwardly from the grating support ledge toward ground level. In normal operation fluid-flow communication exists through a grating disposed on the ledge.

Certain operations such as welding and burning can have disastrous consequences if carried out close to open drains of the aforesaid character. Flammable materials in gaseous and liquid form are often located in the underground lines and represent fire and explosion hazards if ignited.

Process industries, such as oil refineries, are acutely aware of this problem and have taken special steps to isolate their process drains when welding or other potentially harmful operations are to be carried out.

The most common approach for isolating process drains is to cover and surround them with sandbags. This method is less than satisfactory in many instances since bags can tear and release sand which fouls and plugs the drain.

U.S. Pat. No. 3,516,541, issued June 23, 1970, discloses a drain safety device purported to overcome certain disadvantages of sandbagging of drain openings. More particularly, the device shown in such patent incorporates a rigid sheet in which a central opening is formed that is in communication with a depending cylindrical shell housed within an apertured tank secured to the sheet. The peripheral edge portions of the shell rest on body shoulders forming a part of a downwardly extending drain structure. A grated frame rests upon the upper surface of the sheet and removably holds the device in place on the upper portion of the drain structure.

After installation of the device of U.S. Pat. No. 3,516,541, water is discharged thereinto until it flows from the apertures in the tank into the drain structure, the apertures being located above the lower edge of the shell.

In essence, the arrangement of U.S. Pat. No. 3,516,541 creates a water trap or seal which would not be effective to prevent escape of drain gases which are pressurized to sufficient degree.

Furthermore, the device of U.S. Pat. No. 3,516,541 will fail as a seal entirely if the water or other liquid therein falls below the level of the cylindrical shell, as by evaporation.

With such device gases can escape from the underground line without anyone being aware of the fact. This may lull workers into a false sense of security when none in fact exists. Yet another deficiency of this prior art approach is that it requires the use of a mastic material or other sealant applied thereto to provide a seal at the location of contact between the device and the drain structure with which it is associated. The device does not lend itself to use as a temporary plug.

Other prior art structures of a similar character incorporating water traps or barriers are shown in U.S. Pat. Nos. 3,556,993, 4,682,907 and 4,776,722.

DISCLOSURE OF INVENTION

The apparatus of the present invention is of relatively simple and inexpensive construction yet such apparatus is a highly effective safety device for positively sealing a drain assembly leading from ground level to an underground line.

The safety device of the present invention is to be utilized with a drain assembly including a grating support ledge and a peripheral wall extending a predetermined distance upwardly from the grating support ledge toward ground level.

The safety device includes a plate element defining an aperture, the plate element having an upper surface and a thickness less than the predetermined distance. The plate also has an outer peripheral configuration generally corresponding to the configuration of the peripheral wall. The plate element is positionable over the support ledge with the plate element upper surface disposed below ground level.

A housing element is affixed to the plate element and depends downwardly therefrom. The housing element includes fluid-tight outer walls defining an interior closed to the underground line and communicating with the aperture defined by the plate element whereby a predetermined quantity of liquid passing downwardly through the aperture will completely fill the interior and weigh down the safety device.

A seal element is disposed below the plate element and is positionable between the support ledge and the plate element to provide a substantially fluid-tight seal therebetween when the liquid fills the interior of the housing element.

The plate element and the drain assembly peripheral wall define a basin to accommodate overflow of liquid from the housing element interior. The basin is in fluid-flow communication with the interior through the aperture.

The presence of liquid in the basin provides assurance that the housing element interior is completely full and that the device is at maximum operable weight to provide the best possible seal. Furthermore, the presence of bubbles in the liquid in the basin provides a tell-tale indication that the seal is defective and that gas is venting upwardly from the underground line. In virtually all instances, the preferred liquid filling the housing element interior and the basin is water. Since water is heavier than virtually all liquid hydrocarbons, these latter materials, if spilled in the vicinity of the drain, will be prevented by the water from passing into the safety device. Water in the basin will also serve to quench hot sparks or burning debris falling thereinto.

Other features, advantages and objects of the present invention will become apparent with reference to the following detailed description and accompanying drawings.

BEST MODE FOR CARRYING OUT THE INVENTION

Figure 2:
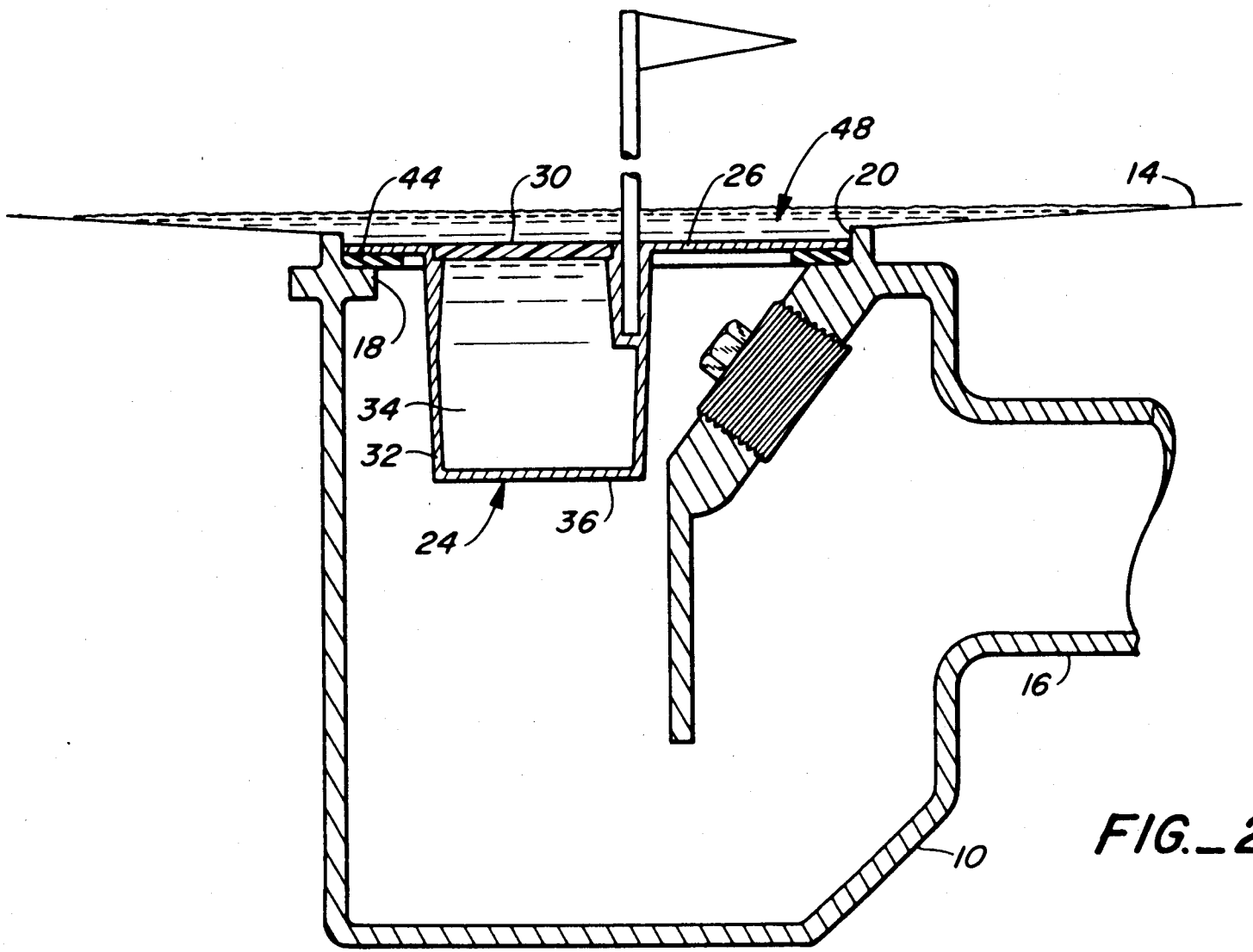
FIG. 2 is a cross-sectional elevation view of a drain assembly with the safety device of the present invention sealing said drain assembly.

FIG. 2 illustrates a typical drain assembly 10 leading from ground level 14 to an underground line 16. The drain assembly 10 includes a grating support ledge 18 and a peripheral wall 20 extending a predetermined distance upwardly from the grating support ledge toward ground level.

Figure 3:
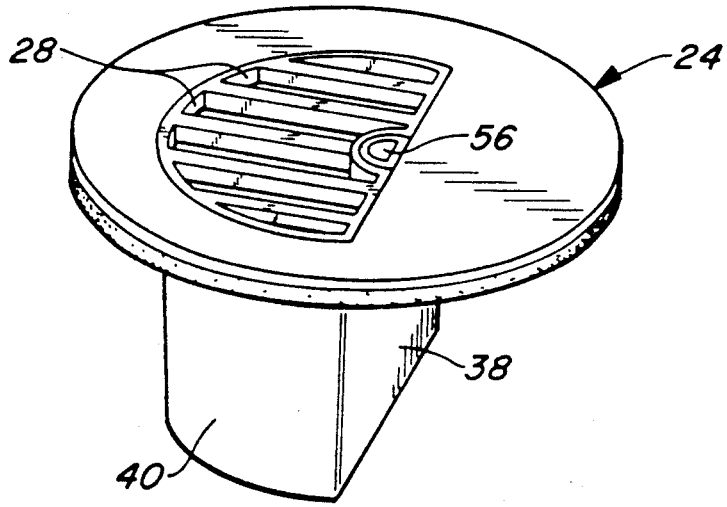
FIG. 3 is a perspective view of the safety device of the present invention.
Figure 4:
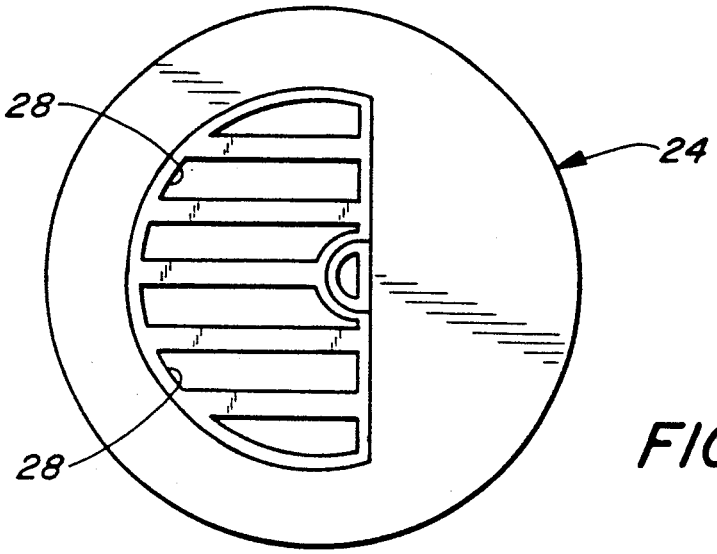
FIG. 4 is a plan view of the safety device.

The safety device 24 of the present invention includes a plate element 26 defining a plurality of apertures 28 (see FIGS. 3 and 4). The plate element has an upper surface 30 and a thickness less than the distance the peripheral wall 20 extends upwardly from the grating support ledge.

The plate has an outer peripheral configuration generally corresponding to the configuration of the peripheral wall and, as may readily be seen with reference to FIG. 2, is positionable over the support ledge with the plate element upper surface 30 disposed below ground level.

A housing element 32 is affixed to the plate element 26 and depends downwardly therefrom. The housing element includes fluid-tight outer walls defining an interior 34 closed to underground line 16 and communicating with the apertures 28 defined by plate element 26. Thus, a predetermined quantity of liquid passing downwardly through apertures 28 will completely fill the interior and weigh down the safety device.

As may be seen with reference to the drawings, the housing element outer walls include a bottom wall 36, a generally planar first side wall 38 extending upwardly from the bottom wall to the plate element and a generally curved second side wall 40 connected to the first side wall at interconnected ends and extending upwardly from the bottom wall to the plate element.

In the illustrated embodiment, the bottom and side walls are integrally formed along with plate element 26. Any suitable material may be utilized in the manufacture of the safety device; however, it has been found that cast iron is a particularly suitable material. However, plastic or other material may be utilized as well.

By configuring the housing element side walls as described above, it will be seen that the safety device may readily be employed with drain assemblies of the type shown in FIG. 2 which incorporate a water trap therein. That is, the housing element is offset with respect to the trap-forming wall of the drain assembly.

Again with particular reference to FIG. 2, the safety device of the present invention also includes a circular-shaped seal element 44 constructed of foam-plastic material or the like. It will be appreciated that the seal element provides a substantially fluid-tight seal between the support ledge and the plate element when the housing element interior is filled with water to weigh down the safety device. By filling up the housing element interior with water to add weight to the safety device the net weight of the safety device itself may be held down for ease of handling.

It will be appreciated that the apparatus of the present invention is designed for temporary use as a replacement for the grating normally supported by the grating support ledge.

When utilizing the safety device of the present invention the operator removes the grating from the support ledge. It is then normally desirable to clean the support ledge 18 and peripheral wall 20, as by means of a wire brush, to establish an environment encouraging proper sealing.

Safety device 24 is then disposed over the drain assembly grating support ledge and lowered into engagement with the support ledge so that plate element 26 is disposed below ground level 14 and defines a basin 48 with peripheral wall 20. Preferably, the top or upper surface 30 of plate element 26 should be disposed at least one quarter inch below the upper extent of the peripheral wall 20.

The next step in installing the safety device 24 is to fill housing element interior 34 with water by pouring same through apertures 28 defined by the plate element.

Filling of the interior 34 with water continues until it overflows and fills basin 48 as well. Complete filling of the housing element interior adds substantial effective weight to the safety device since, of course, water weighs 8.3 pounds per gallon. This establishes a substantially fluid-tight seal between the plate element and the support ledge by compressing the seal element 44 so that it tightly conforms to the lower surface of the plate element and to the grating support ledge.

Figure 1:
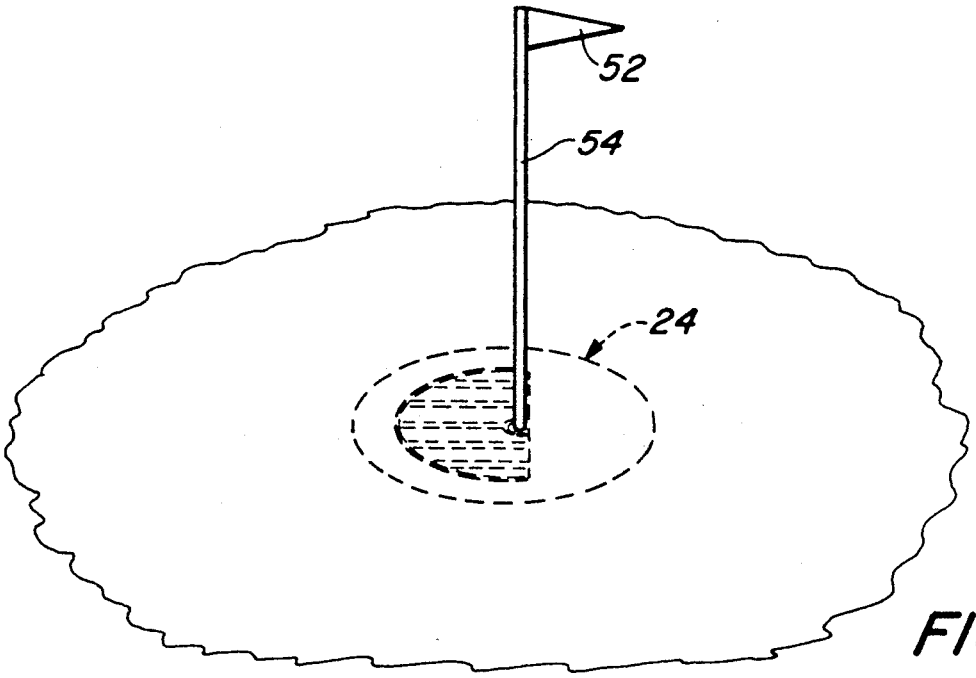
FIG. 1 is a perspective view illustrating the safety device of the present invention after installation thereof and covered with standing ground water.

In practice, where the drain assembly is positioned in a recessed area with the ground surface funneling toward the drain, water may be applied in sufficient quantities to not only fill the basin but to extend into the surrounding ground level area as well (as shown, for example, in FIG. 1). However, insofar as proper operation of the present safety device in concerned, it is only necessary that the basin itself have water or other appropriate liquid therein. When the basin is filled with liquid, there is assurance that the seal is effective. As mentioned above, bubbles in the basin water or a drop in the level thereof evidence improper or inadequate sealing. Also, of course, the water-filled basin will serve to quench sparks or hot debris which may fall from a nearby welding or other work site.

The safety device also includes signal means releasably attached to the plate element and projecting upwardly therefrom through liquid disposed in the basin. Specifically, the signal means comprises a flag 52 on a flexible staff 54. The staff is selectively positionable in a recess 56 defined by the plate element. The flag may, for example, be formed of plastic sheet material or cloth while the staff may be a flexible plastic rod or a coil spring. The staff and flag should have the ability to withstand deformation, as for example by being run over by a vehicle, and be capable of rebounding to the upright condition shown in FIG. 1.

What is claimed is:

1. A safety device for sealing a drain assembly leading from ground level to an underground line, said drain assembly including a grating support ledge and a peripheral wall extending a predetermined distance upwardly from said grating support ledge toward ground level, said safety device comprising;

a plate element defining an aperture, said plate element having an upper surface and a thickness less than said predetermined distance, said plate having an outer peripheral configuration generally corresponding to the configuration of said peripheral wall and positionable over said support ledge with the plate element upper surface disposed below said ground level;

a housing element affixed to said plate element and depending downwardly therefrom, said housing element including fluid-tight outer walls defining an interior closed to said underground line and communicating with the aperture defined by said plate element whereby a predetermined quantity of liquid passing downwardly through said aperture will completely fill said interior and weigh down said safety device, said housing element outer walls including a bottom wall, a generally planar first side wall extending upwardly from said bottom wall to said plate element and a generally curved second side wall connected to said first said wall at interconnected ends and extending upwardly from said bottom wall to said plate element, said bottom and side walls being integrally formed; and a seal element disposed below said plate element and positionable between said support ledge and said plate element to provide a substantially fluid-tight seal therebetween when said liquid fills said interior.

2. The safety device according to claim 1 wherein said plate element and said drain assembly peripheral wall define a basin to accommodate overflow of liquid from said interior, said basin being in fluid-flow communication with said interior through said aperture.

3. The safety device according to claim 2 additionally comprising signal means releasably attached to said plate element and projecting upwardly therefrom through liquid disposed in said basin.

4. The safety device according to claim 3 wherein said signal means comprises a flag on a flexible staff, said staff being selectively positionable in a recess defined by said plate element.

* * * * *